US006437752B1

(12) United States Patent
Chekroun

(10) Patent No.: US 6,437,752 B1
(45) Date of Patent: Aug. 20, 2002

(54) ANTENNA WITH DOUBLE-BAND ELECTRONIC SCANNING, WITH ACTIVE MICROWAVE REFLECTOR

(75) Inventor: Claude Chekroun, Gif S/Yvette (FR)

(73) Assignee: Thomson-CFS, Paris (FR)

( * ) Notice: Subject to any disclaimer, the term of this patent is extended or adjusted under 35 U.S.C. 154(b) by 0 days.

(21) Appl. No.: 09/890,932

(22) PCT Filed: Jan. 31, 2000

(86) PCT No.: PCT/FR00/00220

§ 371 (c)(1),
(2), (4) Date: Aug. 6, 2001

(87) PCT Pub. No.: WO00/46876

PCT Pub. Date: Aug. 10, 2000

(30) Foreign Application Priority Data

Feb. 5, 1999 (FR) ..... 99 01378

(51) Int. Cl.[7] ..... H01Q 19/00; H01Q 19/06

(52) U.S. Cl. ..... 343/754; 343/756; 343/840; 343/909

(58) Field of Search ..... 343/754, 753, 343/756, 781 R, 781 P, 840, 909; 333/21 A, 126, 135; 342/5, 6, 375

(56) References Cited

U.S. PATENT DOCUMENTS

| | | | | |
|---|---|---|---|---|
| 3,569,974 A | | 3/1971 | McLeod, Jr. | 343/754 |
| 3,706,998 A | | 12/1972 | Hatcher et al. | 343/754 |
| 3,758,882 A | | 9/1973 | Moerz | 333/21 A |
| 4,212,014 A | | 7/1980 | Chekroun | 343/754 |
| 4,344,077 A | | 8/1982 | Chedroun et al. | 343/754 |
| 4,447,815 A | | 5/1984 | Chekroun et al. | 343/754 |
| 4,975,712 A | | 12/1990 | Chen | 343/754 |
| 5,001,495 A | | 3/1991 | Chekroun | 343/754 |
| 5,055,805 A | * | 10/1991 | Kan | 333/21 A |
| 5,144,327 A | | 9/1992 | Chekroun et al. | 343/731 |
| 5,237,328 A | | 8/1993 | Dorey et al. | 342/13 |
| 5,280,297 A | | 1/1994 | Profera, Jr. | 343/754 |
| 5,548,289 A | | 8/1996 | Chekroun et al. | 342/16 |
| 5,598,172 A | | 1/1997 | Chekroun | 343/754 |
| 5,635,939 A | | 6/1997 | Chekroun | 342/384 |
| 5,673,056 A | * | 9/1997 | Ramanujam et al. | 343/756 |
| 5,680,136 A | | 10/1997 | Chekroun | 342/6 |
| 5,847,681 A | * | 12/1998 | Faherty et al. | 343/700 MS |
| 5,892,485 A | * | 4/1999 | Glabe et al. | 343/756 |
| 6,191,748 B1 | | 2/2001 | Chekroun et al. | 343/754 |

FOREIGN PATENT DOCUMENTS

| | | |
|---|---|---|
| EP | 0 618 641 | 10/1994 |
| FR | 2 382 109 | 9/1978 |
| FR | 2 689 320 | 10/1993 |
| FR | 2 708 808 | 2/1995 |
| FR | 2 725 077 | 3/1996 |
| FR | 2 747 842 | 10/1997 |

* cited by examiner

*Primary Examiner*—Tan Ho
(74) *Attorney, Agent, or Firm*—Oblon, Spivak, McClelland, Maier & Neustadt, P.C.

(57) ABSTRACT

A dual-band electronic scanning antenna, with an active microwave reflector. The antenna includes at least two microwave sources transmitting in different frequency bands and having opposite circular polarizations. An active reflecting array including elementary cells illuminated by the sources is provided. A polarization rotator is inserted between the reflecting array and the sources, changing the circular polarizations into two crossed linear polarizations. An elementary cell includes a conducting plane and first and second transverse phase shifters, the first phase shifter is substantially parallel to a linear polarization and the second phase shifter is substantially parallel to the other linear polarization. The conducting plane is placed substantially parallel to the phase shifters. The antenna is applicable in particular for microwave applications requiring two transmission bands moreover subject to very low-cost production conditions.

10 Claims, 4 Drawing Sheets

ANTENNA WITH DOUBLE-BAND ELECTRONIC SCANNING, WITH ACTIVE MICROWAVE REFLECTOR

BACKGROUND OF THE INVENTION

The present invention relates to a dual band electronic scanning antenna with an active microwave reflector. It is applicable especially to microwave applications requiring two transmission bands moreover subject to very low-cost production conditions. It may for example be applicable to individual stations for communicating with non-synchronous satellites, and more generally, for numerous types of multimedia applications.

It is known to produce antennas comprising an active microwave reflector. The latter, also known as a "reflect array", is an array with electronically controllable phase shifters. This array lies in a plane and comprises an array of phase-control elements, or phased array, placed in front of the reflecting means, constituted, for example, by a metal plane forming an earth plane. The reflecting array especially comprises elementary cells, each one producing the reflection and phase shifting, which can be varied by electronic control, of the microwave that it receives. Such an antenna provides considerable beam agility. A primary source, for example a horn placed in front of the reflecting array, transmits the microwaves toward the latter.

Mass applications can be envisioned for such antennas, in particular with the advent of interactive multimedia activities via satellite communications networks. In order to provide continuity of a communications network, non-synchronous satellites are placed around the earth. The ground antennas must track the satellites. In order to switch from one satellite to another without phase jumps, the antennas transmit and receive over two frequency bands, with different phase shifts between these two bands.

SUMMARY OF THE INVENTION

One aim of the invention is the production of a dual-band electronic scanning antenna with a reflecting array intended in particular for mass applications, and therefore with a low production cost.

To this end, the subject of the invention is an electronic scanning antenna, characterized in that it comprises at least two microwave sources transmitting in different frequency bands and having opposite circular polarizations, an active reflecting array comprising elementary cells illuminated by the sources and a polarization rotator, inserted between the reflecting array and the sources, changing the circular polarizations into two crossed linear polarizations, an elementary cell comprising two transverse phase shifters, the first phase shifter acting on the waves of one linear polarization and the second phase shifter acting on the waves of the other linear polarization.

BRIEF DESCRIPTION OF THE DRAWINGS

Other objectives, particular features and results of the invention will appear with the help of the following description given by way of example and with respect to the appended drawings which show.

DETAILED DESCRIPTION OF THE INVENTION

Figure 1:
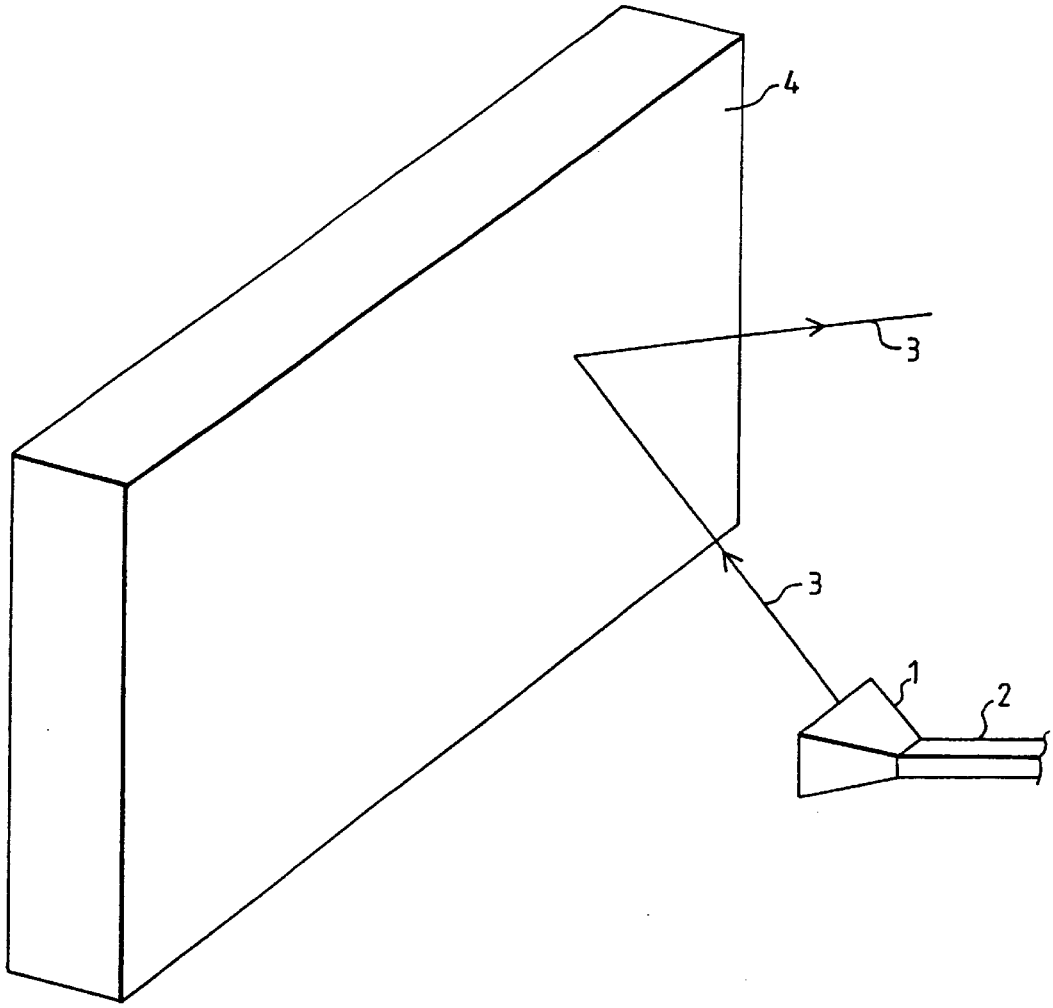
FIG. 1, an exemplary embodiment of an electronic scanning antenna with an active reflecting array.
Figure 1:
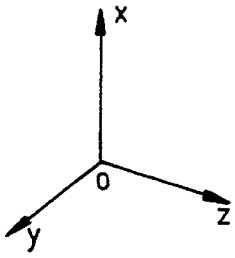

FIG. 1 illustrates schematically an exemplary embodiment of an electronic scanning antenna with an active reflecting array where the microwave delivery is, for example, of the so-called optical type, that is to say, for example, provided using a primary source illuminating the reflecting array. To this end, the antenna comprises a primary source 1, for example a horn. The primary source 1 transmits microwaves 3 toward the active reflecting array 4, placed in the Oxy plane. This reflecting array 4 comprises a set of elementary cells producing the reflection and phase shifting of the waves that it receives. Thus, by controlling the phase shifts imprinted on the wave received by each cell, it is possible as is known, to form a microwave beam in the desired direction.

Figure 2:
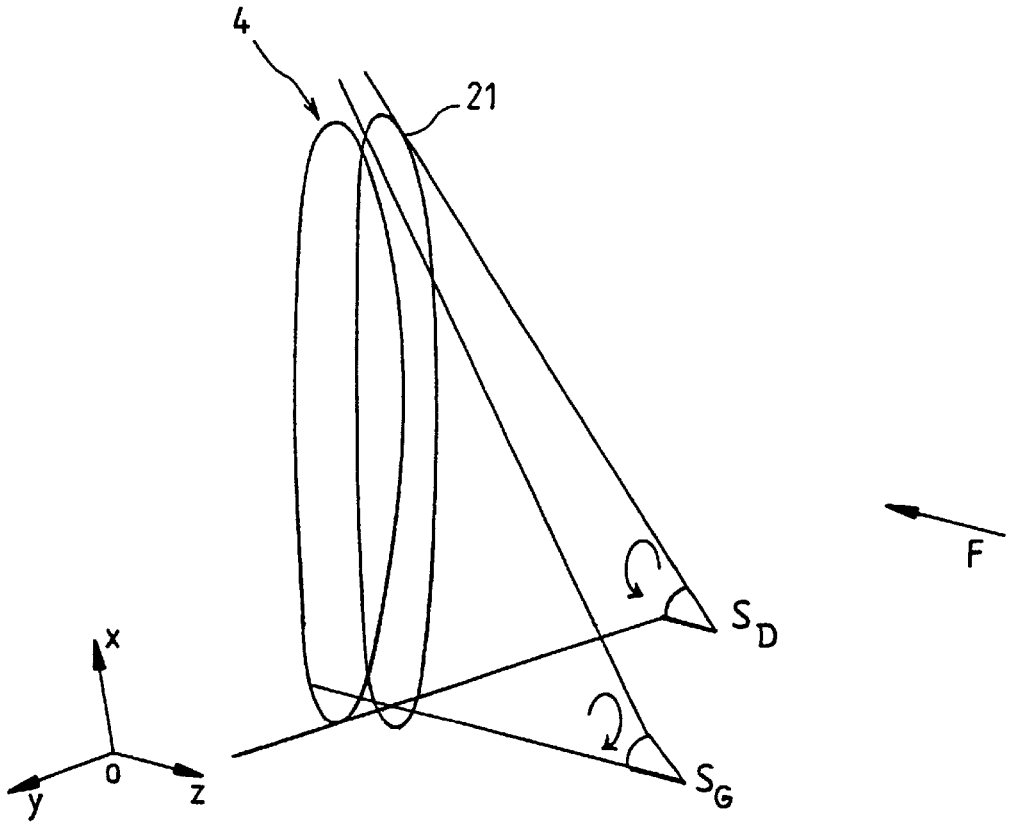
FIG. 2, by a schematic view, an illustration of the operating principle of an antenna according to the invention.

An antenna according to the invention comprises at least two elementary sources, for example, of opposite circular polarizations, to illuminate the active reflector 4, the elementary cells of which possess moreover a given architecture. Moreover, the two sources transmit waves in different frequency bands. FIG. 2 illustrates schematically such an antenna. Hence the latter comprises two sources $S_D$,$S_G$, for example horns, of right and left polarizations, respectively. These horns illuminate an active reflecting array 4 as described above. A polarization rotation grid 21 is placed in front of this reflector 4 and inserted between the latter and the sources $S_D$,$S_G$. The polarization rotation grid changes the waves with circular polarization transmitted by these sources into waves with linear polarization. An antenna according to the invention may also comprise linear elementary sources, with crossed polarizations. In this case, there is no need to use a polarization rotation grid.

Figure 3:
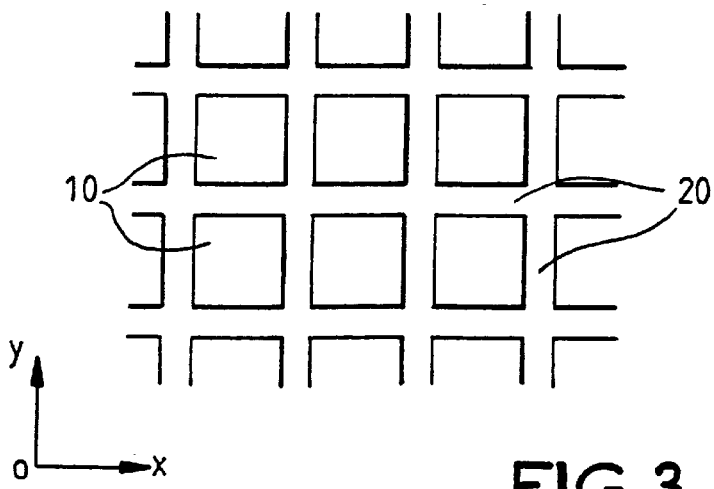
FIG. 3, a partial view of the front face of an example of an active reflective array used in an antenna according to the invention.

FIG. 3 shows schematically part of the reflecting array 4 in the plane Oxy, from a top view, along F. The reflector comprises a set of elementary cells 10 placed side by side and separated by regions 20, used for the microwave decoupling of the cells. These cells 10 produce the reflection and phase shifting of the waves that they receive. An elementary cell 10 comprises a phase shifting microwave circuit placed in front of a conducting plane. More specifically, as will appear below, the microwave circuit comprises two transverse phase shifters, each one dedicated to a linear polarization.

Figure 4:
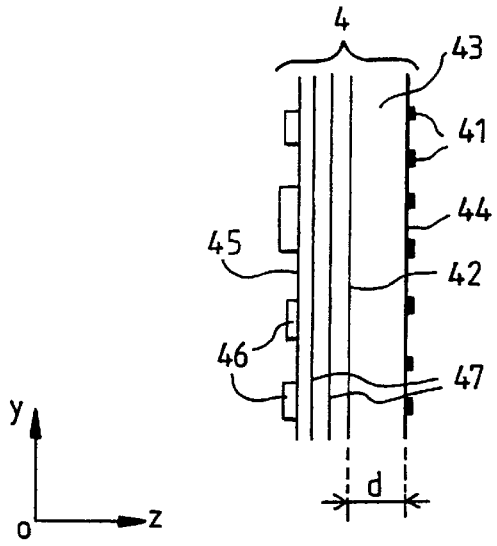
FIG. 4, a partial sectional view of an example of an active array used in an antenna according to the invention.

FIG. 4 is a schematic sectional view, in the Oxz plane of a possible exemplary embodiment of the active reflector 4. The reflector 4 consists of a microwave circuit distributed in the elementary cells 10 and of a conducting plane 42, placed substantially parallel to the microwave circuit 41, at a predefined distance d. This microwave circuit receives the incident waves, for example substantially plane, transmitted by the aforementioned sources $S_D$,$S_G$.

The conducting plane 42 has the particular function of reflecting the microwaves. It may consist of any known means, for example parallel wires or a grating which are close-spaced enough, or a continuous plane. The microwave circuit 41 and the conducting plane 42 are preferably produced on two faces of a dielectric support 43, for example of the printed circuit type. The reflector 4 further comprises, preferably on the same printed circuit 43, which is then a multilayer circuit, the electronic circuit needed to control the phase values. FIG. 4 shows a multilayer circuit, the front face 44 of which carries the microwave circuit 41, the rear face 45 of which carries components 46 of the aforementioned electronic control circuit and the interlayers of which form the conducting plane 42 and, for example, two planes 47 of interconnections of the components 46 to the microwave circuit 41.

Figure 5:
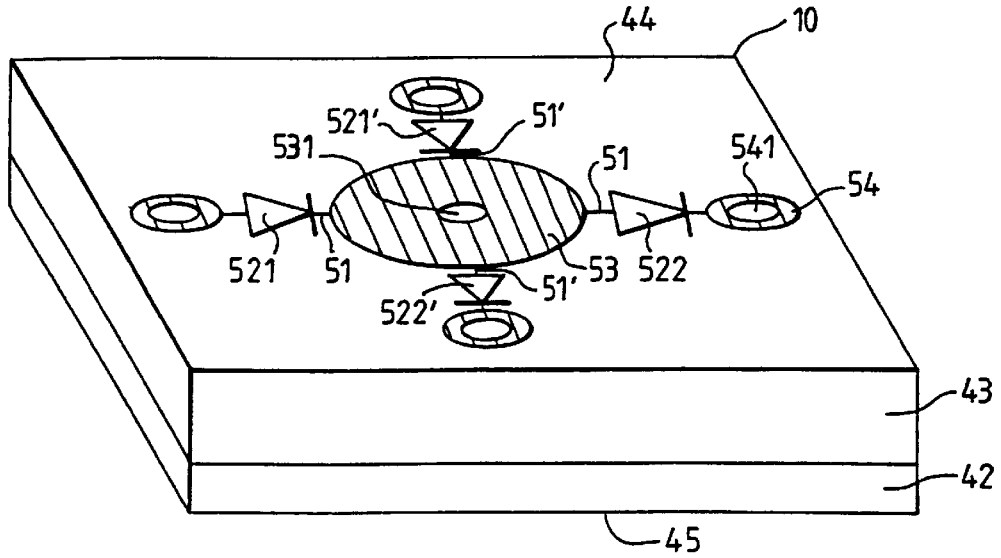
FIG. 5, a detailed perspective view of an exemplary embodiment of an elementary cell of an active reflecting array used in an antenna according to the invention.

FIG. 5 shows, schematically, an exemplary embodiment of an elementary cell 10 of an antenna according to the invention. A cell comprises a phase shifting microwave circuit forming part of the microwave circuit mentioned in relation to FIG. 4. The phase shifter comprises conducting wires 51, 51' placed on a support, for example on the front face 44 of the multilayer circuit 43. The wires 51, 51' each comprise at least two semiconducting elements with two states 521, 521', 522, 522', for example diodes. The exemplary embodiment of FIG. 5 consists of two conducting wires each comprising two diodes in series, wired transversely and connected together by a central control conductor 53. Since the diodes are placed on the front face of the multilayer circuit, the central conductor 53 is for example itself connected to a plated-through hole 531 which connects the conducting wires 51, 51' to the electronic control circuit placed on the rear face 45 of the multilayer circuit, via the interconnection circuits. The central conductor 53 is connected to the four diodes 521, 521', 522, 522' of the phase shifter while being wired between the two diodes of each of the conducting wires 51. The ends of the latter are moreover each connected to a control conductor 54, itself connected for example to a plated-through hole 541 produced in the multilayer circuit 43. The ends of the conducting wires 51, 51' are thus connected to the electronic control circuit. The state, on or off, of each of the four diodes can then be controlled by the electronic control circuit. Each of the wires with diodes acts only on the waves whose polarization, that is to say the electric field vector, has a component which is parallel thereto. Thus, the polarization rotation grid 21 changes, for example, the right circular polarization into a linear polarization parallel to a conducting wire 51 while it change the left circular polarization into a linear polarization parallel to the other conducting wire 51', a conducting wire 51 being for example parallel to the direction Ox and the other conducting wire 51' being for example parallel to the direction Oy.

It is desirable that a wave received by an elementary cell 10 does not propagate to the other neighboring cells. In order to prevent such propagation, the invention provides coupling regions 20 which separate the cells 10. In particular, with regard to a microwave received by the elementary cells 10, linearly polarized parallel to the direction Oy, it is desirable that this wave does not propagate from one cell to another, in the Ox direction. Similarly, it is desirable that a received wave polarized linearly to the direction Ox does not propagate from one cell to the other in the Oy direction.

Figure 6:
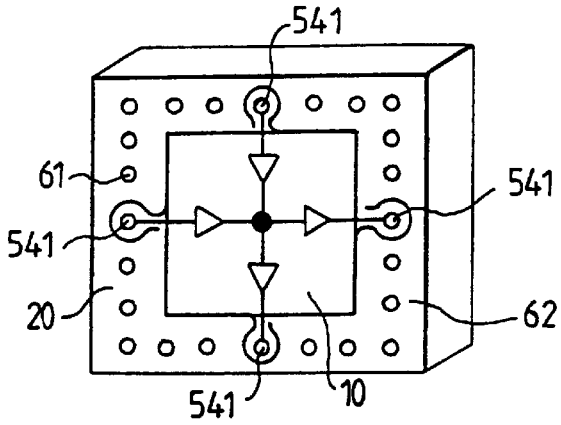
FIG. 6, by way of example, an illustration of an elementary cell provided with protection against undesirable propagation toward and from neighboring cells.

FIG. 6 shows a possible exemplary embodiment of these decoupling regions 20. A decoupling region 20 surrounding an elementary cell comprises a conducting band 62. For reasons of size but also so as not to disturb the operation of the cells, the end conductors 54 which connect the conducting wires to the electronic control circuit are, for example, preferably located in the conducting band 62, without however, being electrically connected to the latter. To this end, the band around the end conductors 54 is interrupted.

The conducting band 62 is for example made by a metal coating on the front face 44, between the cells, parallel to the directions Ox and Oy. This band 62 forms, with the reflecting plane 42 which is below, a space of the wave-guide type, the width of which is the distance d. According to the invention, the distance d is chosen so that it is less than $\lambda/2$, bearing in mind that a wave whose polarization is parallel to the bands cannot be propagated in such a space. In practice, the reflector according to the invention operates in a certain band of frequencies and d is chosen so that it is less than the smallest of the wavelengths of the two bands. Furthermore, the band 62 must be wide enough so that the effect described above is perceptible. In practice, the width may be of the order of $\lambda/15$.

Furthermore, a spurious wave whose polarization would be directed in the direction Oz, normal to the directions Ox and Oy, could be created in a cell. It is also desirable to avoid its propagation toward neighboring cells. For this, it is possible to use, as shown in FIG. 6, the plated-through holes 541 for connecting the conductors 54 to the electronic control circuit. This is because, these latter being parallel to the polarization of the spurious wave, they are equivalent to a conducting plane forming shielding if they are close enough together (at a distance one from the other very much less than the operating wavelength of the reflector), therefore numerous, for the operating wavelengths of the reflector. If this condition is not fulfilled, additional plated-through holes 61 can of course be formed, which have no connection function. If they open out in the conducting band 62, they are then without electrical contact with the latter.

Figure 7:
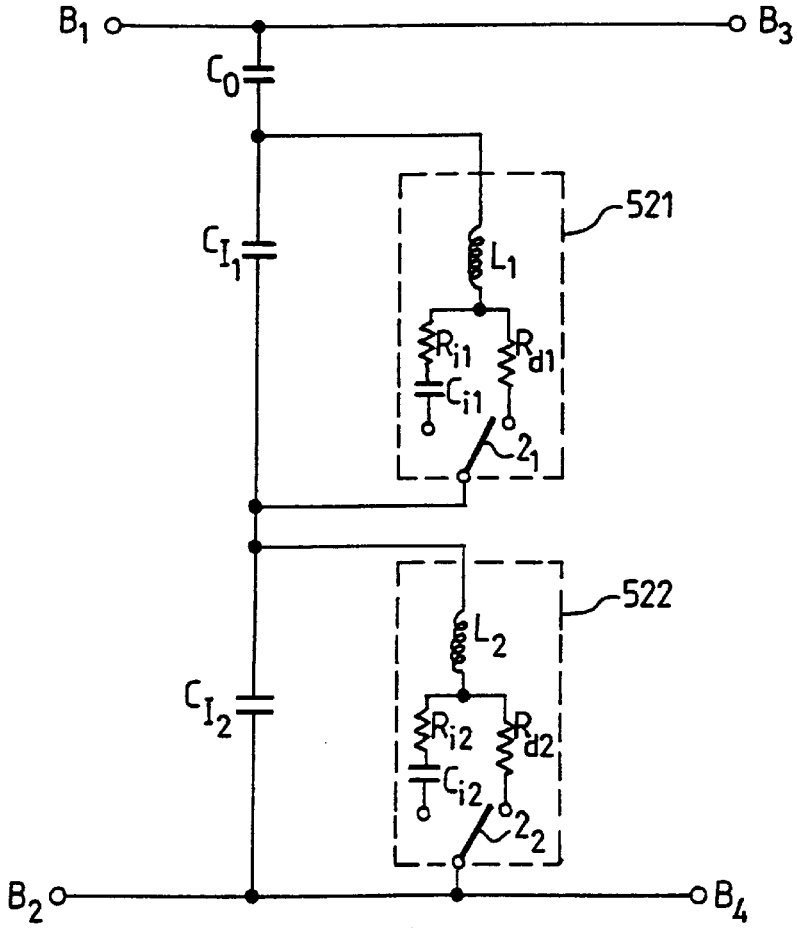
FIG. 7, an equivalent circuit diagram of a phase shifter of an elementary cell.

In order to describe the operation of a cell, it is necessary to consider the equivalent circuit of a phase shifter 10 as shown in FIG. 7. The equivalent circuit relates to a conducting wire 51 and its two diodes 521, 522, which actually corresponds to a phase shifter, associated with a given polarization and therefore with a given frequency band. The incident microwave, of linear polarization parallel to Oy and to the wires 51, is received on terminals $B_1$ and $B_2$ and encounters three capacitors $C_0$,$C_{I1}$, $C_{I2}$ in series, connected in parallel to the terminals $B_1$ and $B_2$. The capacitor $C_0$ represents the capacitance per unit length of decoupling between the end conductors 54 and the conducting band 62 of the decoupling region 20. The capacitor $C_{I1}$, represents the capacitance per unit length between the end conductor 54 connected to the first diode 521 and the central conductor 53. The capacitor $C_{I2}$ represents the capacitance per unit length between the end conductor 54 connected to the second diode 522 and the central conductor 53.

The first diode 521, also shown by its equivalent circuit diagram, is connected across the terminals of the capacitor $C_{I1}$. The first circuit diagram consists of an inductor L, the inductance of the diode 521 taking into account its connection wire, in series with:

- either a capacitor $C_{i1}$ (junction capacitance of the diode) in series with a resistor $R_{i1}$ (reverse resistance),
- or a resistance $R_{d1}$ (forward resistance of the diode), depending on whether the diode 521 is forward or reverse biased, which is symbolized by a switch $\mathbf{2}_1$.

Similarly, the second diode 522, shown by its equivalent circuit diagram, is connected across the terminals of the capacitor $C_{I2}$. The second circuit diagram is similar to that of the first diode 521, its components bearing an index 2.

The microwave output voltage is taken across terminals $B_3$ and $B_4$, the terminals of the capacitors $C_0$,$C_{I1}$, and $C_{I2}$.

The operation of the phase shifter 10 is explained below by considering, in a first step, the behavior of such a circuit in the absence of the second diode 522, which amounts to removing 522 and the capacitor $C_{I2}$ from the equivalent circuit diagram of FIG. 7. When the first diode 521 is forward biased, the susceptance $B_{d1}$ of the circuit of FIG. 7 (modified) can be written:

$$B_{dI} = Z \cdot C_0 \cdot \omega \cdot \frac{1 - LC_{II}\omega^2}{LC_{II}\omega^2 + LC_0\omega^2 - 1}$$

where Z is the impedance of the incident wave and ω is the angular frequency corresponding to the central frequency of one of the two operating bands of the antenna. By way of example, it is considered that the first conducting wire 51 receives the waves transmitted by the right circular polarization source $S_D$.

The parameters of the circuit are chosen, for example, so that $B_{d1}=0$, that is to say that, on neglecting its conductance, the circuit is matched or, in other words, that it is transparent to the incident microwave, introducing neither spurious reflection nor phase shifting ($d\phi_{d1}=0$). More specifically, the following is chosen:

$$LC_{II}\omega^2=1$$

which leads to $B_{d1}\equiv 0$, whatever the value in particular of the capacitance $C_{i1}$.

When the first diode is reverse biased, the susceptance $B_{r1}$ of the circuit can be written:

$$B_{rI} = Z \cdot C_0 \cdot \omega \cdot \frac{1 - LC_{II}\omega^2 + (C_{II}/Ci)}{LC_{II}\omega^2 + LC_0\omega^2 - 1 + \frac{C_0 + C_{II}}{C_i}}$$

Since the capacitance $C_{I1}$ was fixed in advance, it appears that the value of the susceptance $B_{r1}$ can be adjusted by changing the value of the capacitance $C_i$, that is to say the choice of the diode 521.

If now, in a second step, the existence of the second diode 522 is taken into account, it can be seen that, by similar reasoning, two other separate values are obtained for the susceptance, depending on whether the diode 522 is forward or reverse biased.

Thus it appears that a phase shifter of a cell 10, this phase shifter corresponding to a conducting wire 51, 51', may have four different values for its susceptance $B_D$ (called $B_{D1}$, $B_{D2}$, $B_{D3}$ and $B_{D4}$) depending on the command (forward or reverse bias) applied to each of the diodes 521, 522. These values are a function of the parameters of the circuit of FIG. 7, that is to say of the values chosen for the geometric parameters (dimensions, shapes and spacings of the different conducting surfaces) and electrical parameters (electrical characteristics of the diodes) of the phase shifter. In particular, it is necessary to take into account the restriction in defining the conducting band 62 mentioned above on determining the various parameters for fixing the phase shifts $d\phi_1$–$d\phi_4$.

If the behavior of the whole cell 10 is now studied, that is to say the phase shifter combined with the conducting plane 42, the susceptance due to this plane 42, brought back into the plane of the phase shifter and called $B_{cc}$, must be taken into account, which susceptance may be written:

$$B_{cc} = -cotg\frac{2\pi d}{\lambda}$$

where λ is the wavelength corresponding to the angular frequency ω.

The susceptance $B_c$ of the cell is then given by:

$$B_C=B_D+B_{CC}$$

It follows that the susceptance $B_c$ is able to take four separate values (called $B_{C1}$, $B_{C2}$, $B_{C3}$ and $B_{C4}$) corresponding to the four values of $B_D$, respectively, the distance d representing an additional parameter for determining the values $B_{C1}$–$B_{C4}$.

It is known moreover that the phase shift (dϕ) superimposed by an admittance (Y) imprinted on a microwave is of the form:

$$d\phi=2 \text{ arc tan } Y$$

Thus it appears that, by neglecting the real part of the admittance of a cell, we have:

$$d\phi=2 \text{ arc tan } B_c$$

and that four possible values ($d\phi_1$–$d\phi_4$) of phase shift are obtained per cell, depending on the command applied to each of the diodes $D_1$ and $D_2$. The various parameters are chosen so that the four values $d\phi_1$–$d\phi_4$ are equally distributed, for example but not necessarily: 0, 90°, 180°, 270°. These four states correspond to a digital command coded over two bits. It is possible to extend a command to three bits corresponding to eight states, each one phase shifted for example by 45°, by adding for example a diode to the conducting wire 51.

It should be noted that the case described above is that in which the circuit parameters have been chosen so that the zero (or virtually zero) susceptances are such that they correspond to diodes biased in the forward direction, but that it is of course possible to choose symmetrical operation in which the parameters are determined in order to virtually cancel out the susceptances $B_r$; more generally, it is only necessary for one of the susceptances $B_d$ or $B_r$ to be zero, these values being determined such that the condition of equal distribution of the phase shifts $d\phi_1$–$d\phi_4$ is fulfilled.

The operation of an elementary cell according to its second conducting wire 51' can be described in a similar manner, for waves transmitted by the second source, for example $S_G$, in another frequency band. Thus, according to the invention, the active array 4 is illuminated by two sources $S_D$, $S_G$ transmitting two different frequency bands in right and left circular polarizations, respectively, the polarization rotation grid 21 changing these two circular polarizations into two crossed linear polarizations making it possible for the cells of the active array 4 to act independently on two polarizations and in different frequency bands. An elementary cell 10 in fact comprises two transverse phase shifters, preferably controllable, the first chase shifter 51, 521, 522 acting on the waves of one and the second phase shifter 51', 521', 522' acting on the linear polarization other waves of the linear polarization. In particular, in order to act on a wave of given polarization, a phase shifter, and therefore its conducting wire, is substantially parallel to the direction of this polarization. To this end, the polarization rotation grid 21 is placed such that the linear polarizations obtained from the circular polarizations are virtually parallel to the phase shifters relating to them.

After reflection and phase shifting on the active reflector 4, the waves pass again through the polarization rotation grid 21. The crossed linear polarizations then become left and right circular polarizations again, a vertical polarization being, for example, changed into a right circular polarization and a horizontal polarization being, for example, changed into a left circular polarization. The polarization rotation grid may be any polarization rotator, in particular, it may be a meander grid or a wire grid.

Advantageously, the invention makes it possible to operate over two frequency bands and to adjust the phase shifts of the waves reflected by the active array, independently from one band to the other. Bearing in mind that these phase shifts determine the direction of the beams transmitted by the antenna, it is therefore easy and quick to change the direction of the beam for the two frequency bands. This is particularly well suited for following non-synchronous satellites located about the earth and used in particular for all sorts of multimedia applications. Finally, an antenna according to the invention is well suited for mass use, that is to say intended for the general public, since it can be produced at low cost. This is because it does not comprise components which are expensive or complex to implement. In particular, the active array, consisting of a multilayer printed circuit with components placed on its front and rear faces, is not expensive to produce. Furthermore, it is perfectly suited to mass production. Finally, the polarization rotation grid, used particularly in the case where the elementary sources are circularly polarized as is the case for example for multimedia applications, is also cheap.

What is claimed is:

1. An electronic scanning antenna, comprising at least two microwave sources transmitting in different frequency bands, an active reflecting array comprising elementary cells illuminated by the sources, an elementary cell comprising a conducting plane and first and second transverse phase shifters, the first phase shifter being substantially parallel to a linear polarization and the second phase shifter being substantially parallel to the other linear polarization, the conducting plane being placed substantially parallel to the first and second phase shifters, one of the first and second phase shifters comprising at least one dielectric support, at least one conducting wire placed on the support and bearing at least two semiconducting elements with two states, the wire being connected to control conductors of the semiconducting elements connected to an electronic control circuit, the characteristics of the cell being such that a given phase shift value of the electromagnetic wave reflected by the cell whose polarization is substantially parallel to the conducting wire, corresponds to each of the states of the semiconducting elements.

2. The antenna as claimed in claim 1, wherein one of the control conductors is central and each of the first and second phase shifters comprises two semiconducting elements, the central conductor is connected to the semiconducting elements.

3. The antenna as claimed in claim 1, wherein the elementary cells are separated by microwave decoupling regions, a decoupling region comprising a conducting band surrounding a cell substantially parallel to the polarization directions and forming, with the conducting plane, a guided space where a wave of the-two frequency bands cannot be propagated.

4. The antenna as claimed in claim 3, wherein the support is a multilayer printed circuit, a first face of which bears the microwave circuits, a first interlayer bears the conducting plane, and the second face bears components of the electronic control circuit.

5. The antenna as claimed in claim 4, wherein the dielectric support comprises in addition at least a second interlayer bearing interconnections of the electronic control circuit.

6. The antenna as claimed in claim 4, wherein the microwave decoupling region comprises plated-through holes made in the dielectric support at a distance one from the other of less than the electromagnetic wavelength.

7. The antenna as claimed in claim 6, wherein some of the plated-through holes provide the connection between the control circuit and control conductors.

8. The antenna as claimed in claim 6, wherein the plated-through holes are made in the conducting band but without electrical contact with the latter.

9. The antenna as claimed in claim 1, wherein the semiconducting elements are diodes.

10. The antenna as claimed in claim 1, wherein the sources have opposite circular polarizations, and further comprising a polarization rotator inserted between the reflecting array and the sources, changing the circular polarizations into two crossed linear polarizations.

* * * * *

UNITED STATES PATENT AND TRADEMARK OFFICE

CERTIFICATE OF CORRECTION

PATENT NO. : 6,437,752 B1
DATED : August 20, 2002
INVENTOR(S) : Chekroun

It is certified that error appears in the above-identified patent and that said Letters Patent is hereby corrected as shown below:

Title page,
Item [73], the Assignee information should read:
-- [73] Assignee: Thomson-CSF, Paris (FR) --

Signed and Sealed this

Thirty-first Day of December, 2002

JAMES E. ROGAN
*Director of the United States Patent and Trademark Office*